United States Patent [19]

Culley, Jr.

[11] Patent Number: 4,724,877

[45] Date of Patent: Feb. 16, 1988

[54] SELF CENTERING PLANER APPARATUS

[75] Inventor: Donnell H. Culley, Jr., Pelham, Ala.

[73] Assignee: CEMCO Volunteer Associates, Whitesburg, Tenn.

[21] Appl. No.: 37,167

[22] Filed: Apr. 10, 1987

[51] Int. Cl.[4] ..... B27C 1/00

[52] U.S. Cl. ..... 144/116; 144/242 B; 144/253 R; 144/117 R

[58] Field of Search ..... 144/114, 117, 242 R, 144/242 A, 242 C, 253 R, 253 G

[56] References Cited

U.S. PATENT DOCUMENTS 2,102,186 12/1937 Nicholson et al. ..... 144/116
2,312,439 3/1943 Peterson ..... 144/116
2,815,051 12/1957 Spanhel et al. ..... 144/242 B
2,957,506 10/1960 Baumann et al. ..... 144/116

*Primary Examiner*—W. Donald Bray
*Attorney, Agent, or Firm*—Jennings, Carter, Thompson & Veal

[57] ABSTRACT

A blade planer utilizes a centering mechanism to locate the centerline of lumber on the datum plane intermediate a pair of offset blade planer heads. The centering mechanism includes a plurality of opposed shoes which are hydraulically or mechanically linked such that displacement of one shoe from a predetermined reference yields a simultaneous equal displacement in the opposing shoe. Biased return to the reference ensures that the shoes are always centered on the datum plane regardless of the separation of the blade planer heads.

20 Claims, 7 Drawing Figures

43a
42a
41a
37a
48
38a
36a
44
44a
21a
33
31
34
32
44b
47
25
20
A
31
32
33
34
21b
air
oil
19
36b
11
46
38b
46
37b
41b
43b
42b

SELF CENTERING PLANER APPARATUS

FIELD OF THE INVENTION

The present invention relates to the field of processing lumber and more particularly to the art of planing lumber to a desired thickness. In greater particularity, the invention relates to blade planers and particularly to dual sided blade planers wherein both sides of a piece of lumber are planed in a single operation. Even more particularly, the present invention relates to such a blade planer wherein the blade planers remove an equal amount of wood from each side of the lumber.

BACKGROUND OF THE INVENTION

Planers and sanders are well known in the art and their function in shaping wood to a desired thickness is well known. Blade planers are well known and it is generally accepted that such planers require less power to operate than do belt planers or sanders. It is clear that to achieve double sided planing of the lumber in a single operation, the planer apparatus on each side of the lumber must remove an amount of wood relative to the centerline of the wood. Many centering apparatus have been proposed for use in such planers, but none have been found to be totally satisfactory for use with blade planers. My U.S. Pat. No. 4,417,680 shows an excellent feed mechanism for a belt sander, however, even this apparatus is not completely compatible with a blade planer.

Two problems not present in belt sanders confront the use of a blade planer. First, the cutting action of the blades imparts a discontinuous series of input forces to the lumber which causes oscillation unless the lumber is firmly held in position. Therefore blade planers cannot be mounted in direct opposition as are the belt sanders of my previous invention. Secondly, when lumber which is already very close to or slightly less than the desired thickness is fed into a blade planer apparatus, the staggered configuration of the blade planers requires that the lumber be supported adjacent at least one of the blade planers. Oftentimes this results in the lumber being aligned along one side thereof rather than along the centerline and consequently, with a thin board, one of the blade planers removes an excessive amount of wood thereby reducing the thickness beyond a usable level. For example, a planer may be set to plane boards having a thickness of 15/16ths inches or greater into boards having a thickness of ¾ inches, with the first blade planer set to remove ⅛ inch and the second set to remove 1/16 inch or vice versa. If a board having a thickness of 13/16" reaches the planer, the first blade planer removes ⅛" resulting in a "scant" board having a thickness of 11/16". Considerable numbers of "scant" boards are produced daily by planers which are incapable of properly centering lumber.

SUMMARY OF THE INVENTION

It is the object of the invention to provide a means for centering lumber fed into a blade planer which will assure that equal amounts of wood are removed from each side of the piece of lumber.

More specifically, it is the object of my invention to provide an apparatus which will center lumber for equal planing of both sides regardless of the thickness of the lumber so as to eliminate scant boards.

Another object of the invention is to provide an efficient blade planer which can achieve the above objects.

My improved apparatus utilizes an upper and lower frame assembly with the upper portion being movable vertically relative to the lower frame. Each frame member carries a conventional blade planer and a plurality of feed rollers which include rubber tires, pinwheel rollers, and steel rollers. The spacing between the upper and lower frame members defines the thickness of the resultant board and the datum plane. Lumber fed into apparatus embodying my invention is centered on the datum line by a pair of guide shoes which are interconnected such that as one shoe moves, it forces the other shoe to move a like distance from the datum plane. In one embodiment, the shoes are hydraulically connected and in other embodiments, they are mechanically linked.

BRIEF DESCRIPTION OF THE DRAWINGS

Apparatus embodying features of my invention are illustrated in the accompanying drawings which form a portion of this invention and wherein.

DESCRIPTION OF A PREFERRED EMBODIMENT

Figure 1:
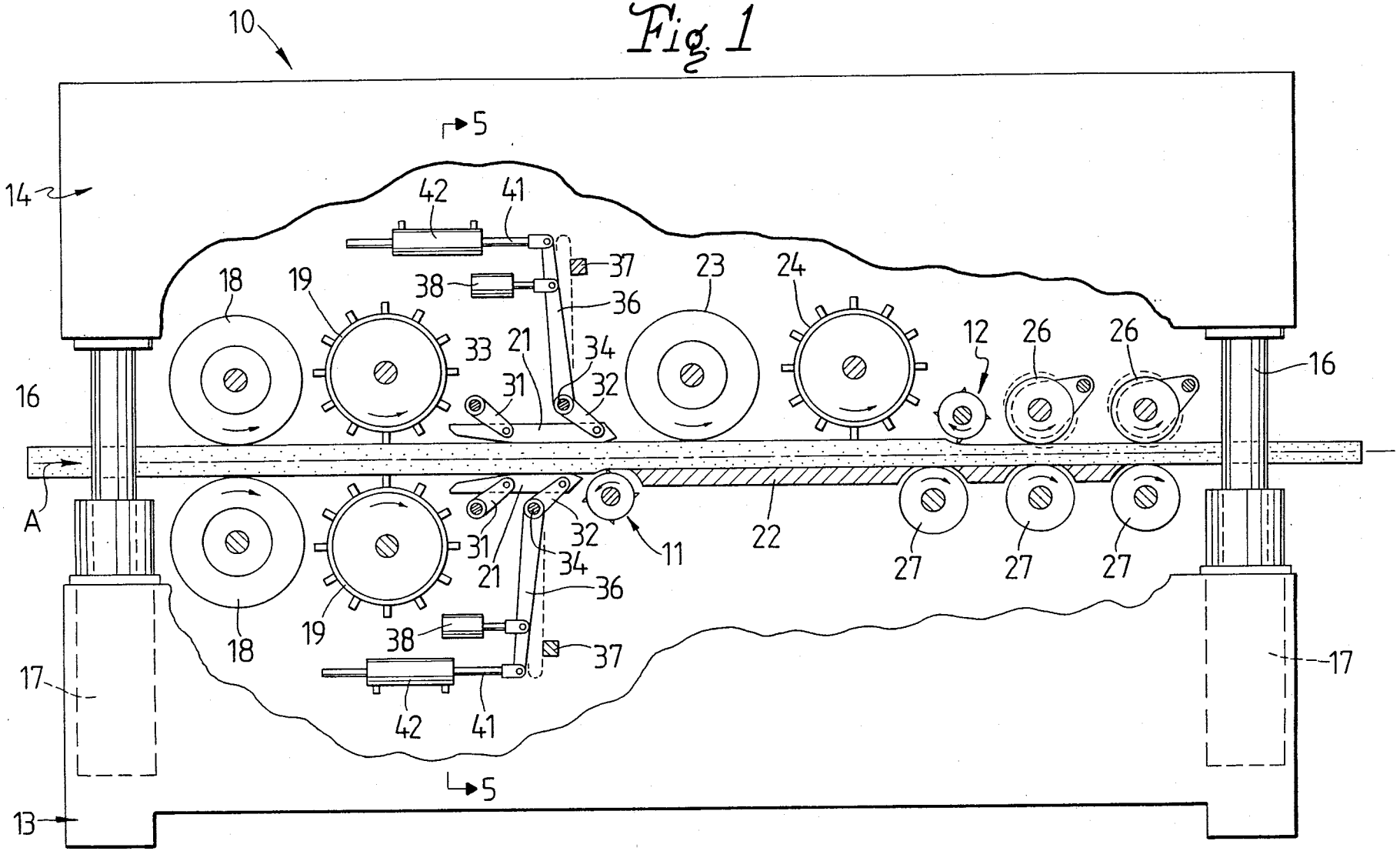
FIG. 1 is a side elevation of a planer apparatus partially cut away to show the feed and alignment means.

Referring to FIG. 1, my invention is shown in the form of a board planer 10 which utilizes a pair of conventionally driven blade planers 11 and 12. The board planer has a lower frame assembly 13 and an upper frame assembly 14 with four corner columns 16 supporting the upper frame assembly 14. Each corner column 16 rests on a jack 17 and each jack 17 is ganged to the other three jacks such that the four corner columns are raised and lowered by the same amount at the same time. As may be seen, blade planer 12 is carried by the upper frame assembly 14, thus the elevation of the upper frame assembly 14 above the lower frame assembly determines the vertical separation between the blade planers 11 and 12 which equals the thickness of the finished board. It is thus apparent that the separation may be varied as desired to yield finished lumber of virtually any thickness.

Figure 7:
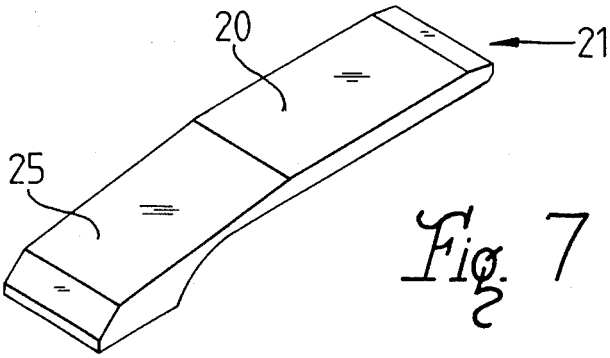
FIG. 7 is a detail of the guide members.

Lumber is fed into the apparatus in the direction indicated by arrow A and is engaged by input rollers 18 and 19 which are driven for rotation by a motor, not shown. The rollers 18 are rubber tire-like rollers whereas the rollers 19 are pinwheel rollers of the type disclosed in my prior U.S. Pat. No. 4,417,680. These input rollers urge the lumber along a feed path through the apparatus generally along the datum plane defined by the centerline between blade planers 11 and 12. Positioned intermediate pinwheel rollers 19 and lower blade planer 11 are a plurality of pairs of shoes 21 or guides which are spaced equidistantly from the datum plane. The shoes 21 are elongated members, shown more precisely in FIG. 7, having a generally planar surface 20 and a sloping forward surface 25 beveled at approximately 7° counter to the surface 25 of the opposing shoe. The paired shoes are connected as explained more fully herein such that the shoes move concomitantly toward and away from the datum plane. Howver, it should be noted that the upper shoes extend somewhat over the lower blade planer 11 such that the lumber is held firmly against the blade planar 11 and is not subject to oscillation or displacement due to impact with the blades of the blade planer 11. Downstream of the lower blade planer 11 the board is supported on a platen 22 and urged along the feed path toward upper blade planer 12 by an intermedidate set of driven rollers 23 and 24 with roller being of the rubber tire type and rollers 24 being of the pinwheel type. Output rollers 26 and 27 discharge the board from the apparatus. Each of these rollers are steel rollers with selected rollers 26 being driven. The plurality of rollers and shoes insure that the boards are held firmly and do not oscillate with the impact of the blade planers, thus the surfaces of the boards are not marred by the apparatus. Although not disclosed or claimed in the present application, it is noteworthy to mention that the thickness of the boards planed by the apparatus may be set to within 0.005" and displayed on a digital readout.

Such fine tolerance in a blade planer requires that the boards be accurately aligned as they pass both blade planers 11 and 12. This alignment is accomplished through the use of the shoes 21. Each shoe is mounted to its associated frame on link members 31 and 32, which are pivotally mounted on transverse shafts 33 and 34 respectively, such that the planer face 20 of the shoe remains parallel to the datum plane at all times. Link members 32 have an extension or centering arm 36 which serves to transfer motion of the shoe 21 to a centering mechanism. The centering mechanism may be either hydraulic or mechanical in nature.

Figure 2:
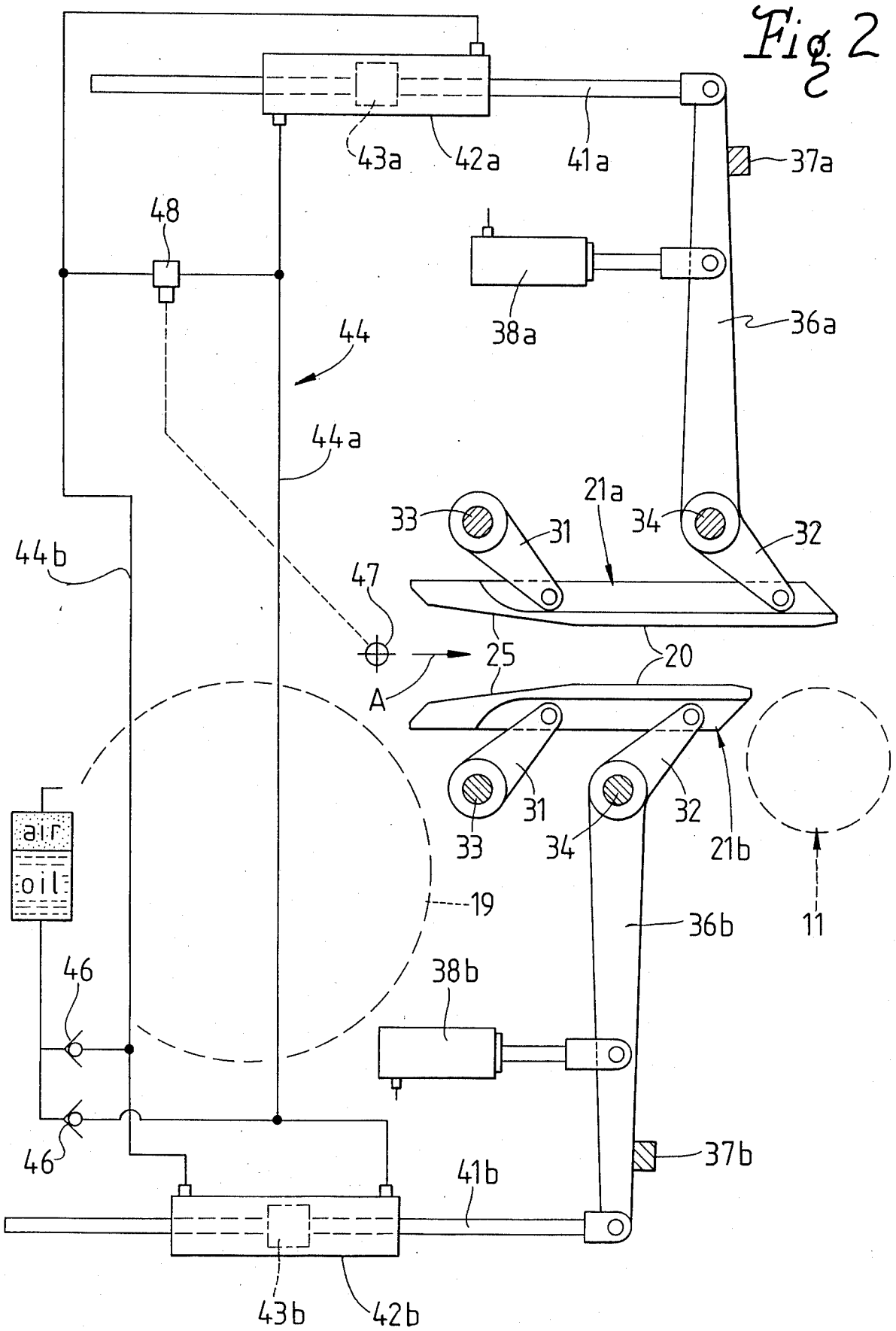
FIG. 2 is a schematic depiction of the center mechanism utilizing a hydraulic connection.

A hydraulic centering system is schematically depicted in FIG. 2. Note that centering arm 36 is urged against a stop member 37 by an air cylinder 38. The shoes 21 are in a reference centered position when arm 36 abuts the stop member 37. That is, the shoes 21 are at their minimum separation for the particular board thickness desired. In this position, the shoes 21 are spaced relative to the blade planers 11 and 12 such that a board having the desired thickness or less would pass through the apparatus without being touched by either planer and the faces 20 are nearly tangent to the arc formed by the associated planer 11 or 12.

The distal end 39 of arm 36 is connected to a piston rod 41 of a double acting hydraulic cylinder 41. A cylinder piston 43 is conventionally moved by rod 41. For clarity, the upper frame components have been given a suffix "a" and the lower frame components a suffix "b". The upper and lower cylinder 42*a* and *b* of a pair of shoes 21*a* and *b* are connected by a set of hydraulic lines 44 such that movement of arm 36*a* away from stop member 37*a* creates pressure in cylinder 42*a* which is transmitted to cylinder 42*b* to urge arm 36*b* away from stop member 37*b*. The hydraulic pressure is in equilibrium only when shoes 21*a* and *b* are equally displaced from their centered reference points, thus whenever a board enters between the shoes, it is held with its centerline coinciding with the datum plane, and equal amounts of wood are removed by each blade planer 11 and 12.

Connected to each cylinder via the hydraulic lines 44*a* and *b* and a set of check valves 46 is a pressurized reservoir which replenishes the hydraulic fluid in the event of a leak in one of the cylinders. Also, it is necessary to be certain that the pressure in the system is equalized, thus a photocell 47 senses the absence of lumber at the entrant portion of the shoes 21 and opens a valve 48 between the lines 44*a* and *b* to equalize the pressure therein as the shoes 21 are reset by the air cylinders 38*a* and *b*, which may be driven by shop air or any other convenient source. It is to be understood that arms 36 may be urged into engagement with stop members 37 by a variety of biasing devices other than air cylinder 38.

Figure 3:
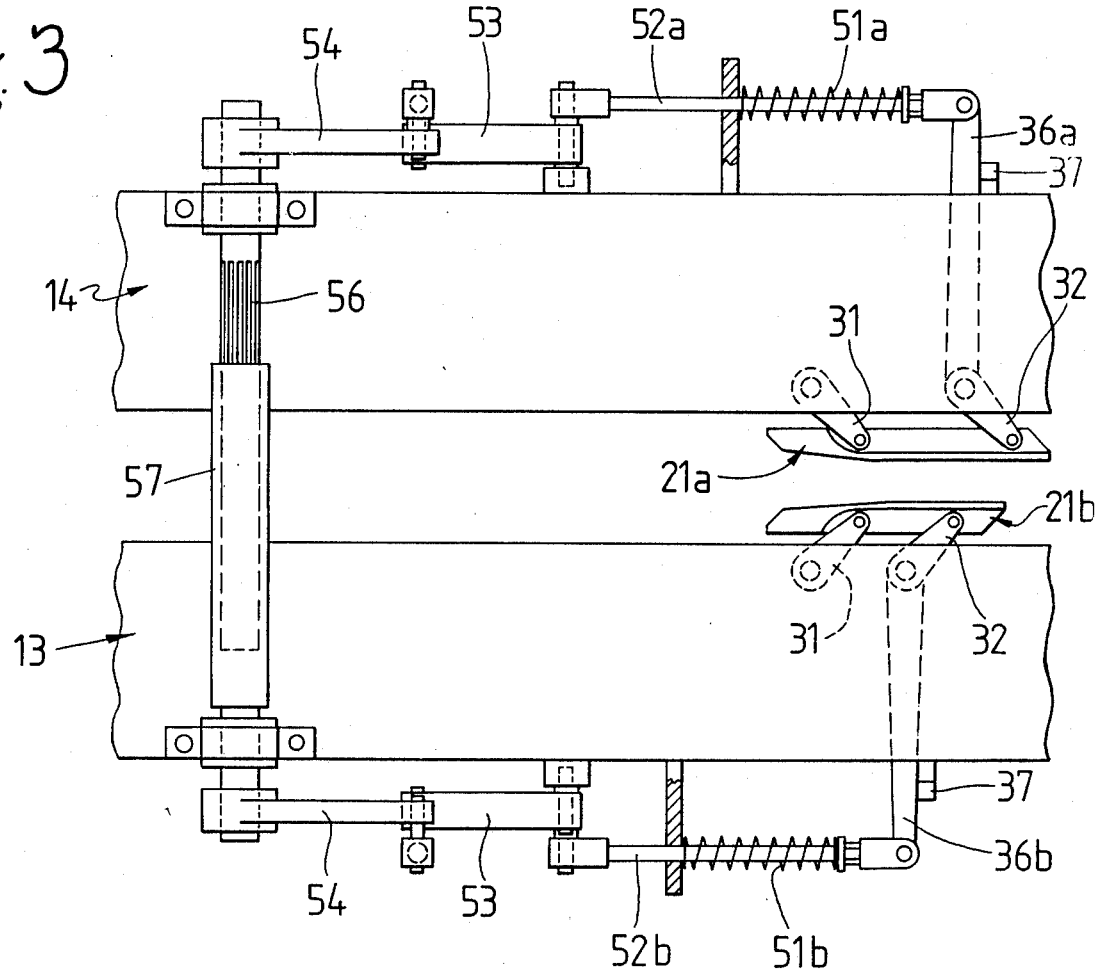
FIG. 3 is a schematic elevation of a mechanical centering system.
Figure 4:
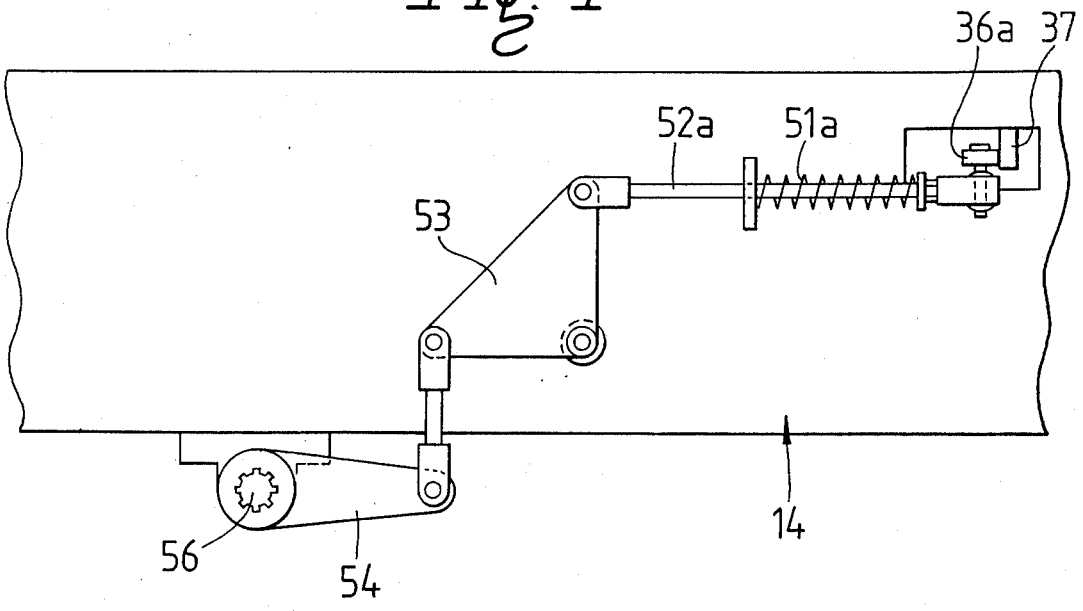
FIG. 4 is a plan view of the system shown in FIG. 3.
Figure 5:
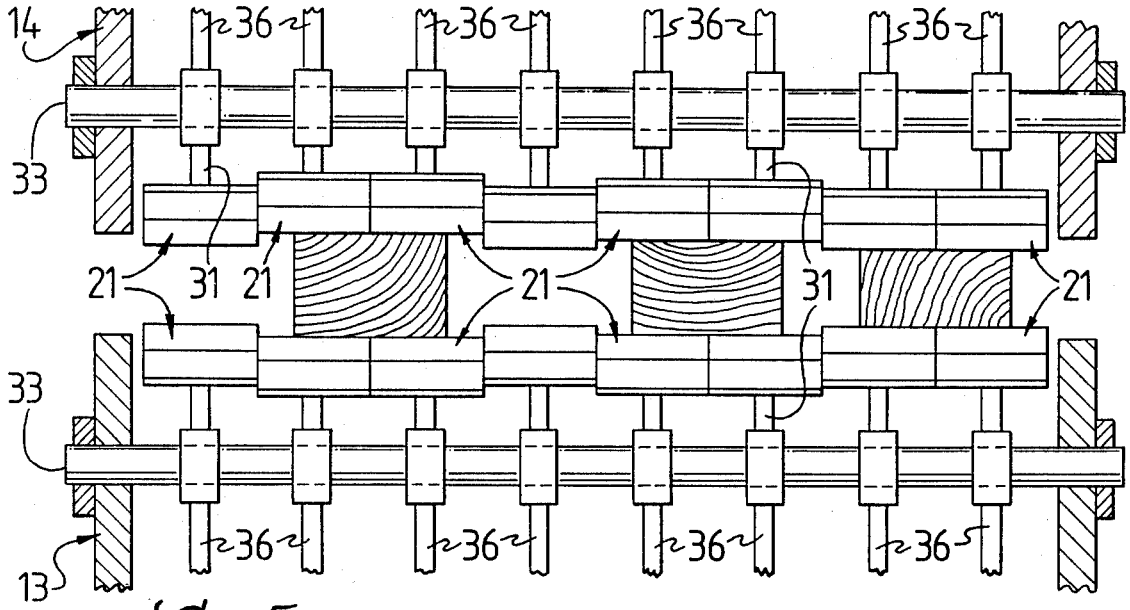
FIG. 5 is a partial sectional view along line 5—5 of FIG. 1.
Figure 6:
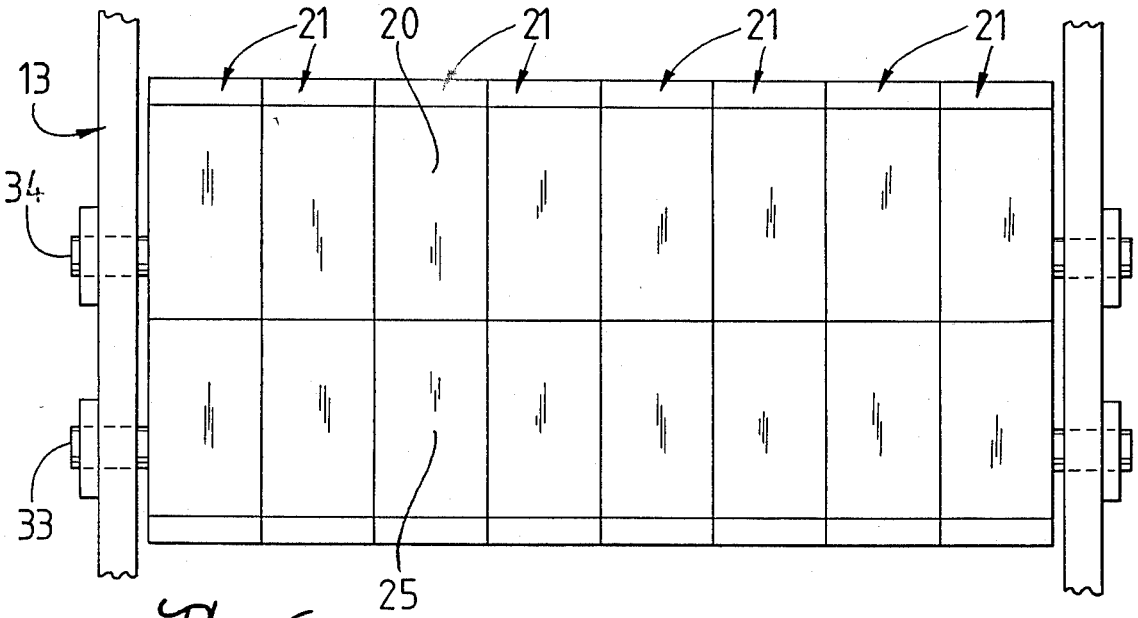
FIG. 6 is a plan view of the guide members.

FIGS. 3 and 4 illustrate a mechanical embodiment wherein arms 36 are biased against stop member 37 by springs 51*a* and *b* (note that the weight of the board may necessitate spring 51*b* bing slightly stronger than spring 51*a*) and is connected to a rod 52 which translates the pivotal motion of the arm 36 into horizontal motion. The rod 52 is in turn connected to a bell crank 53 or like device which is pivotally connected to a lever arm 54 connected to a vertical shaft 56. The vertical shaft 56 is splined and fits within a sleeve 57 such that the combined length of the shaft 56 and sleeve 57 may be varied in accordance with the vertical displacement of the upper frame member 14. Identical members connect the centering arms 36 of the lower shoes 21 to the sleeve 57. It may be seen that if either shoe 21 is displaced toward or away from its reference centered position, the mechanical linkage associated therewith will cause the shaft 56 and sleeve 57 to rotate which, in turn, causes the opposing shoe and its linkage to move the same amount. It will be appreciated that several variations of the mechanical linkage may be constructed as long as the connection between the upper and lower shoe linkage can be varied with the elevation of the upper frame assembly.

While I have shown my invention in two forms, it will be obvious to those skilled in the art that it is not so limited but is susceptible of various changes and modifications without departing from the spirit thereof.

What I claim is:

1. In apparatus for removing equal amounts of wood from pieces of lumber utilizing a pair of blade planers offset equal distances from a datum plane along which said lumber is fed, and a plurality of input and output rollers for urging said lumber along said datum plane, the improvement comprising:

(a) a pair of opposed guide members spaced equidistantly from said datum plane; and (b) centering means affixed to said guide members for causing concomitant displacement of said guide members relative to said datum plane responsive to the passage of lumber through said apparatus.

2. The improvement as defined in claim 1 wherein said centering means comprises:

(a) means for biasing said guide members toward a reference centered position; and (b) means responsive to displacement of each guide member from said datum plane for displacing the other guide members an equal amount.

3. The improvement as defined in claim 2 wherein said centering means further comprises:

(a) first link member pivotally connected to said guide member near one end thereof and pivotally mounted to said apparatus; and (b) second link member mounted parallel to said first link member, pivotally connected near a second end of said guide member and pivotally mounted to said apparatus and having an extended arm connected to said means for biasing and said means for displacing.

4. The improvement as defined in claim 3 wherein said guide members comprise planar members having an entrant end beveled outwardly from said opposing guide members with said upper member extending over one of said blade planers.

5. The improvement as defined in claim 2 further comprising means for adjusting said means for displacing such that said means for displacing yields equal displacement of each of said guide members for each piece of lumber.

6. The improvement as defined in claim 2 wherein said means for displacing comprises:

(a) first double acting hydraulic cylinder connected to one of said pair of guide members such that movement of said guide member displaces fluid within said cylinder;

(b) second double action hydraulic cylinder connected to the other of said pair of guide members such that movement of said guide member displaces fluid within said cylinder; and (c) means connecting said first and second double acting hydraulic cylinders for fluidic communication such that the fluid displaced in said first cylinder is of equal volume with the fluid displaced in said second cylinder.

7. The improvement as defined in claim 6 further comprising means for maintaining a replenishing supply of fluid to said hydraulic cylinders and said connecting means and means for equalizing the hydraulic fluid in each side of said hydraulic cylinders.

8. The improvement as defined in claim 1 wherein one guide member of said pair of guide members, one blade planer of said pair of blade planers, are movable concomitantly vertically relative to said other guide members and said other planer such that said datum plane may be raised or lowered in accordance with the desired thickness of lumber.

9. The improvement as defined in claim 8 wherein said centering means comprises:

(a) means for biasing said guide members toward a reference centered position; and (b) means responsive to displacement of each guide member from said datum plane for displacing the other guide members an equal amount.

10. The improvement as defined in claim 9 wherein said guide members are pivotally mounted such that the opposed faces thereof remain parallel during said concomitant displacement and with said reference centered position for each guide member being fixed relative to one of said blade planers.

11. The improvement as defined in claim 2 wherein said guide members are pivotally mounted such that the opposed faces thereof remain parallel during said concomitant displacement and with said reference centered position for each guide member being fixed relative to one of said blade planers.

12. The improvement as defined in claim 11 wherein said means for displacing comprises a hydraulic balance system converting pressure applied to one of said pair of guide members during the displacement thereof into hydraulic pressure applied to the other of said guide members such that said guide members are equally displaced.

13. The improvement as defined in claim 12 further comprising means for maintaining a replenishing supply of hydraulic fluid to said system and means for equalizing the fluid within said system responsive to the absence of lumber inphut to said guide means.

14. The improvement as defined to claim 8 wherein said guide members are pivotally mounted such that the opposed faces thereof remain parallel during said concomitant displacement and with said reference centered position for each guide member being fixed relative to one of said blade planers.

15. The improvement as defined in claim 14 wherein said centering means comprises:

(a) centering arms pivotally connected to each guide member and movable about a horizontal axis concomitantly with vertical displacement of the associated guide member;

(b) link members connected to said centering arms and movable horizontally responsive to the pivotal motion of said centering arms;

(c) means connecting said link members for each pair of guide members for imparting concomitant motion of said link members; and (d) means biasing said guide members to a reference centered position.

16. The improvement as defined in claim 15 wherein said means for imparting comprises a vertically mounted splined shaft connected at each end to one of said link members such that horizontal motion thereof rotates said shaft.

17. Apparatus for removing equal amounts of wood from each face of pieces of lumber having a lower frame and a movable upper frame with the separation of said lower and upper frame defining a datum plane in accordance with the thickness desired for said lumber comprising:

(a) input feed means supported for rotation on said lower and upper frame members for urging said lumber along a feed path between said upper and lower frame members generally along said datum plane;

(b) a lower blade planer supported on said lower frame;

(c) intermediate feed means supported on said upper frame member for urging said lumber along said feed path;

(d) an upper blade planer supported on said upper frame member;

(e) output feed means supported for rotation on said upper and lower frame members for discharging said lumber along said path;

(f) upper and lower guide members mounted in opposition on said frame members intermediate said input feed means and said lower blade planer with said upper guide members biased toward a reference position relative to said upper blade planer and said lower guide members biased toward a reference position relative to said lower blade planer; and (g) means affixed to said guide members for causing concomitant displacement of opposed guide members relative to said datum plane responsive to the passage of lumber therebetween.

18. The apparatus as defined in claim 17 wherein each of said guide members has a generally planer face confronting said opposed guide member and a beveled entrant position adjacent said input feed means with each guide member being pivotally mounted to an associated frame member such that the planer faces thereof remain parallel during said concomitant displacement.

19. The apparatus as defined in claim 17 wherein said means for causing concomitant displacement of said guide members comprises means for converting displacement of any of said guide members into hydraulic pressure for application to an opposed guide means such that said opposed guide member is displaced equally.

20. The apparatus as defined in claim 17 wherein said means for causing concomitant displacement of said guide members comprises a mechanical linkage connecting said guide members such that motion by one of said guide members relative to said datum plane causes an equal motion of an opposed guide member in the same relative direction.

* * * * *